US011328884B2

(12) United States Patent
Zhou et al.

(10) Patent No.: US 11,328,884 B2
(45) Date of Patent: May 10, 2022

(54) VARIABLE-SPEED CIRCUIT BREAKER AND SWITCHING METHOD FOR SAME

(71) Applicant: Eaton Intelligent Power Limited, Dublin (IE)

(72) Inventors: Xin Zhou, Wexford, PA (US); Wangpei Li, Horseheads, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 18 days.

(21) Appl. No.: 16/907,425

(22) Filed: Jun. 22, 2020

(65) Prior Publication Data

US 2020/0411261 A1 Dec. 31, 2020

Related U.S. Application Data

(60) Provisional application No. 62/866,771, filed on Jun. 26, 2019.

(51) Int. Cl.
*H01H 33/666* (2006.01)
*H01H 71/24* (2006.01)
(Continued)

(52) U.S. Cl.
CPC ..... *H01H 33/666* (2013.01); *H01H 33/38* (2013.01); *H01H 33/59* (2013.01);
(Continued)

(58) Field of Classification Search
CPC ..... H01H 33/666; H01H 33/38; H01H 33/59; H01H 33/66238; H01H 71/2463; H01H 71/2481; H01H 71/7463
(Continued)

(56) References Cited

U.S. PATENT DOCUMENTS 4,331,998 A * 5/1982 Matsko ..... G05B 19/08 361/93.2
6,126,152 A * 10/2000 Santos ..... F16F 9/04 267/118
(Continued)

FOREIGN PATENT DOCUMENTS

DE 202012001498 U1 * 3/2012 ..... F16J 3/041
DE 202012001498 U1 * 3/2012
KR 20170056970 A * 5/2017

OTHER PUBLICATIONS

Bini, R. et al., "Interruption Technologies for HVDC Transmission: State-of-Art and Outlook", 2017 4th International Conference on Electric Power Equipment—Switching Technology-Xi'an-China, downloaded May 12, 2020.
(Continued)

*Primary Examiner* — Scott Bauer
*Assistant Examiner* — Sreeya Sreevatsa
(74) *Attorney, Agent, or Firm* — Eckert Seamans Cherin & Mellott, LLC

(57) ABSTRACT

A circuit breaker includes at least one moveable contact. The moveable electrode is operably connected to a Thomson coil actuator that can separate and open the contacts of the circuit breaker. A sensor senses current or voltage in the circuit breaker. When a condition exists that triggers an opening action, a controller will use select a current level to apply to the Thomson coil actuator. The selected current level will vary based on the sensed current or voltage level. The controller will cause a driver to apply the selected current level to the Thomson coil actuator, and it will cause the contacts to separate and open. If the circuit breaker is a vacuum interrupter, the vacuum interrupter may employ a multi-section bellows in which each section has unique structural characteristics as compared to the other sections,
(Continued)

so that different sections will dominate as the Thomson coil's speed of operation varies.

19 Claims, 7 Drawing Sheets

(51) Int. Cl.
*H01H 33/38* (2006.01)
*H01H 33/662* (2006.01)
*H01H 33/59* (2006.01)
*H01H 71/74* (2006.01)

(52) U.S. Cl.
CPC .. *H01H 33/66238* (2013.01); *H01H 71/2463* (2013.01); *H01H 71/2481* (2013.01); *H01H 71/7463* (2013.01)

(58) Field of Classification Search
USPC ..... 361/91.1
See application file for complete search history.

(56) References Cited

U.S. PATENT DOCUMENTS 6,331,687 B1 * 12/2001 Dunk ..... H01H 11/0062 218/140
6,930,271 B1 8/2005 Palmieri et al.
7,508,645 B2 * 3/2009 Trivette ..... H01H 33/6662 361/139
RE41,036 E * 12/2009 Bushey ..... A47L 11/4011 318/135
7,829,814 B2 11/2010 Marchand et al.
8,791,779 B2 7/2014 Jonsson
8,982,538 B2 3/2015 Leccia et al.
9,396,896 B2 7/2016 Chen et al.
9,842,713 B2 12/2017 Yu et al.
10,580,599 B1 3/2020 Wang et al.
10,957,505 B2 * 3/2021 Chen ..... H01H 33/666
2017/0154747 A1 6/2017 Bissal et al.
2020/0402751 A1 * 12/2020 Chen ..... H01H 33/42
2020/0402752 A1 12/2020 Leccia et al.
2020/0411261 A1 12/2020 Zhou et al.

OTHER PUBLICATIONS

Pei, X. et al., "Fast operating moving coil actuator for a vacuum", IEEE Transactions on Energy Conversion, 32(3), 931-940, 2017.

* cited by examiner

VARIABLE-SPEED CIRCUIT BREAKER AND SWITCHING METHOD FOR SAME

RELATED APPLICATIONS AND CLAIM OF PRIORITY

This patent document claims priority to U.S. Provisional Patent Application No. 62/866,771, filed Jun. 26, 2019. The disclosure of the priority application is fully incorporated into this document by reference.

BACKGROUND

Circuit breakers, sometimes referred to as circuit interrupters, include electrical contacts that connect to each other to pass current from a source to a load. The contacts may be separated in order to interrupt the delivery of current, either in response to a command or to protect electrical systems from electrical fault conditions such as current overloads, short circuits, and high or low voltage conditions.

In certain medium voltage circuit breakers, for example medium voltage direct current (DC) hybrid circuit breakers, it is desirable to have a vacuum interrupter in which the contacts move with a fast opening speed. Some ultra-fast switching mechanisms such as Thomson coil actuators can open the contacts in as few as 500 microseconds, with peak speeds of travel approaching 10 m/s. In conditions that approach short circuit conditions, the circuit breaker must achieve a sufficiently large contact gap (typically 1.5 mm or 2 mm) in this short time frame. Traditional motor-driven and linear actuators cannot achieve such opening speeds.

However, the fast action of Thomson coil actuators can also create a significant amount of stress on a circuit breaker. Thomson coils act fast and stop hard, and this can cause a high level of mechanical impact on the switching mechanism and the pole unit of the breaker. This can reduce the mechanical life of the circuit breaker or various components of it (such as the bellows of the vacuum interrupter, which expands or compresses during operation of the breaker). This can cause the circuit breaker to wear out quickly, or require that the breaker be constructed with extra-heavy duty materials, thus increasing cost and reducing ease of transport and installation.

This document describes methods and systems that are intended to address some or all of the problems described above.

SUMMARY

In various embodiments, a method of operating a circuit breaker is disclosed. The circuit breaker employs a high-speed actuator, such as a Thomson coil, that is operable to separate and open contacts of the circuit breaker. When a controller detects that a condition exists that triggers an opening action, it will also receive (from a sensor) a sensed level of current or voltage in the circuit breaker during the condition. The controller will select a current level to apply to the Thomson coil actuator, wherein the selected current level will vary based on the level of current or voltage detected by the sensor. The controller will cause a driver to apply the selected current level to apply to the high speed actuator, which will cause the contacts of the circuit breaker to separate and open.

In various embodiments, selecting the current level to apply to the actuator may include determining that the sensed level corresponds to an overload condition. In response, the controller may select a full current level that corresponds to a fastest speed of operation that the actuator can achieve. If the controller determines that the sensed level is above a rated level of the circuit breaker but below an overload condition, then the controller may select a current level that corresponds to a less than full level, which will cause the actuator to operate at a speed that is less than its fastest speed of operation.

If the controller determines that the sensed level is at or below a rated level of the circuit breaker but below an overload condition, then the controller may select a current level that corresponds to a less than full level, and that is less than a current level that the controller would select if the sensed level were above the rated level but below an overload condition. Alternatively, the controller may select a current level that will not cause the high-speed actuator to actuate, and instead the controller may cause a driver to apply current to a linear actuator and thus cause the contacts to separate and open by action of the linear actuator instead of the high-speed actuator.

In various embodiments, the circuit breaker may be a vacuum interrupter, and the moveable contact may be connected to a moveable electrode. The movable electrode may extend into a bellows. The bellows may include multiple sections, each of which exhibits one or more structural differences as compared to the other sections. If so, then when the controller causes the driver to apply the selected current level to the high-speed actuator and separate the contact, this action will cause one of the sections of the bellows to move more than the other sections.

In various embodiments, the circuit breaker may comprise a vacuum interrupter that includes a bellows. The bellows may have multiple sections, each of which exhibits one or more structural differences as compared to the other sections. For example, two or more sections of the bellows may be constructed of different materials, and/or may have different thicknesses, and/or may have differently sized folds. If so, then applying the selected current level to the actuator will cause a first section of the bellows to move more quickly than, or to a greater distance than, a second section of the bellows.

BRIEF DESCRIPTION OF THE DRAWINGS

FIG. 1A illustrates an example circuit breaker, while

DETAILED DESCRIPTION

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

The term "medium voltage" (MV) systems include electrical systems that are rated to handle voltages from about 600 V to about 1000 kV. Some standards define MV as including the voltage range of 600 V to about 69 kV. (See NECA/NEMA 600-2003). Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible subranges within that range, such as approximately 1 kV to approximately 38 kV.

Figure 1A:
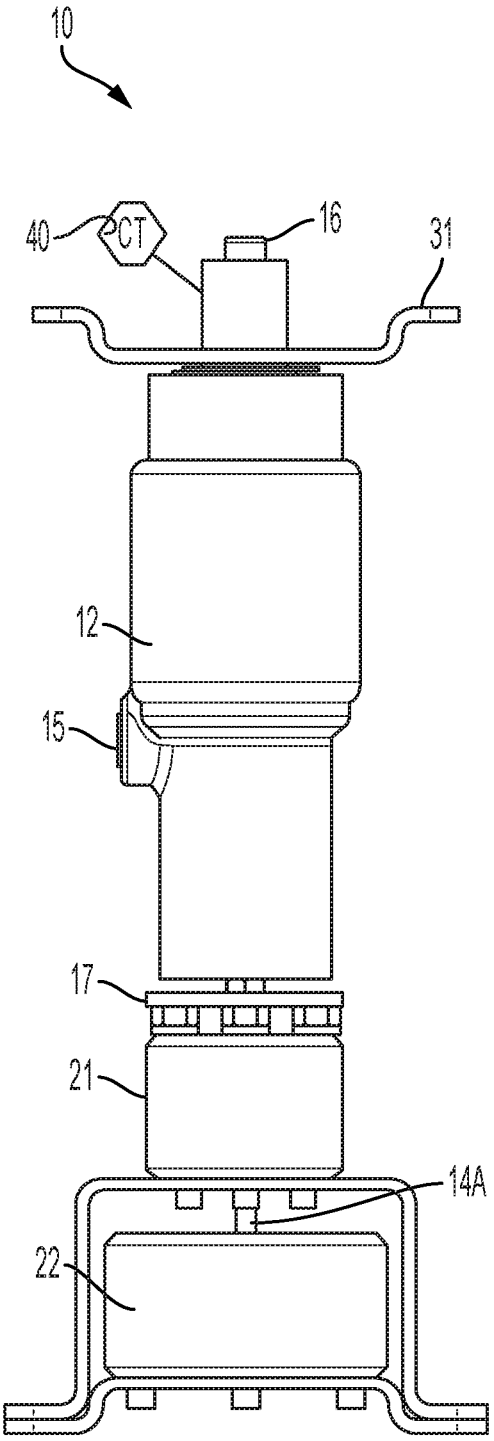
Figure 1B:
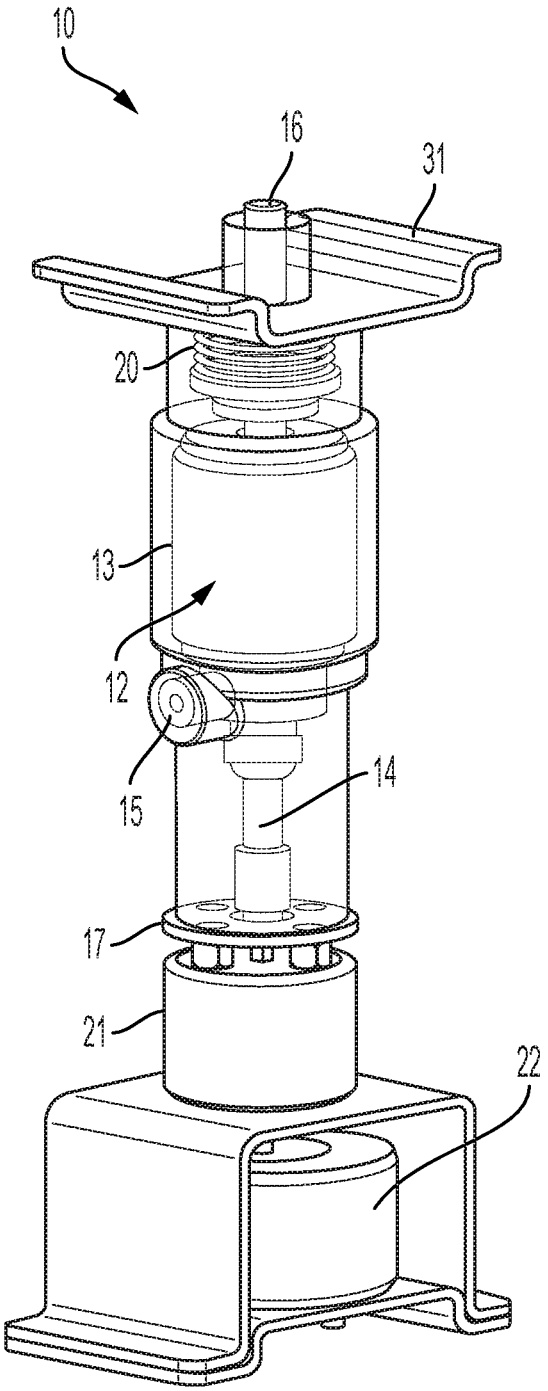
FIG. 1B illustrates the circuit breaker with certain internal components shown.

Referring to FIGS. 1A and 1B, a vacuum interrupter switch 10 in accordance with an aspect of the disclosure is shown. The vacuum interrupter switch 10 may be a standalone circuit breaker, or it may be a component of a larger circuit breaker such as a hybrid circuit breaker. Thus, in the discussion below, we may refer to the vacuum interrupter switch 10 as a circuit breaker, and use the terms interchangeably unless the context specifically notes otherwise (as with FIG. 7). In some embodiments, the circuit breaker/vacuum interrupter switch 10 may be employed in a direct current (DC) system to interrupt DC power. In other embodiments, the circuit breaker/vacuum interrupter switch 10 may be employed in an alternating current (AC) circuit, for example as a single pole of a three-pole AC circuit breaker.

Figure 2A:
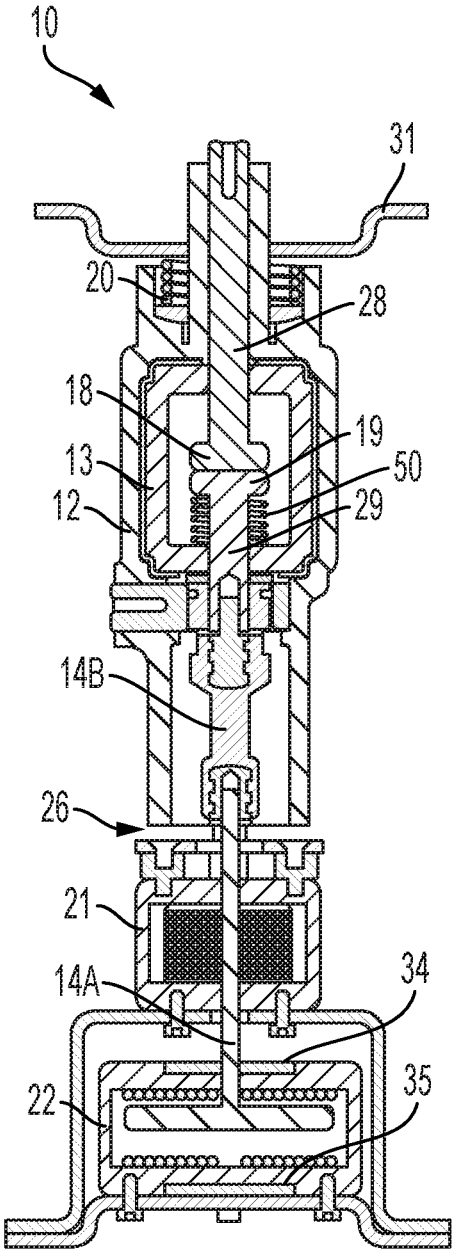
FIG. 2A illustrates a cross-sectional view of the example circuit breaker of FIGS. 1A-1B in a closed position.

The circuit breaker 10 includes a pole unit 12 that contains a vacuum interrupter 13. Referring to the cross-sectional views of FIG. 2, the vacuum interrupter 13 includes a housing that contains a sealed vacuum chamber that holds a moving electrode 29 that leads to a moving contact 19, and a fixed electrode 28 that leads to a fixed contact 18. The moving electrode 29 and moving contact 19 are electrically connected to a first terminal 15 (shown in FIG. 1), and the fixed electrode 28 and fixed contact 18 are electrically connected to a second terminal 16 (shown in FIG. 1). The terminals extend from the pole unit 12 such that one of the terminals may be electrically connected to a power source and the other terminal may be electrically connected to a load, thus positioning the vacuum interrupter 13 to interrupt the delivery of power to the load when the contacts 18, 19 are separated With continued reference to FIGS. 1A and 1B, a linkage 14 that includes one or more arms or other collective structures formed of a non-conductive (insulating) material will extend from the moving electrode 29 to and beyond an end of the pole unit 12 that is relatively proximate to the moving electrode 29. (In this discussion, the term "relatively proximate" to a point means that the referenced item is closer to that point than an alternate point. For example, in this situation, it means that this refers to an end of the pole unit 12 that is closer to the moving electrode 29 than it is to the fixed electrode 28.) The cross section view of FIG. 2A illustrates that the linkage may include one or more components (such as conductive rod 14A) that extend beyond the pole unit 12, one or more components (such as non-conductive connector 14B) that are included within the pole unit, and any variation of intermediate interconnecting components that operate so that when the external components (such as conductive rod 14A) are pulled or pushed, the internal components (such as non-conductive connector 14B) will be moved by a corresponding force.

The breaker also includes a Thomson coil actuator 22.

A segment (conductive rod 14A) of the linkage extends from the pole unit 12 to the Thomson coil actuator 22. Example components of the Thomson coil actuator will be discussed below in the context of FIG. 3

A sensor 40 (as shown in FIG. 1) will be electrically connected to either of the terminals 15, 16, either directly or via a conductor that leads to or from the terminals. The sensor 40 may be a current sensor, a voltage sensor, or another type of sensor that is capable of measuring a parameter of power that is being transferred through the circuit breaker 10.

Optionally, the system also may include a linear actuator 21 that is mechanically positioned in series with the Thomson coil actuator 22 so that the linear actuator 21 is positioned between the Thomson coil actuator 22 and the pole unit 12. The linear actuator 21 may be for example, a solenoid; a magnetic actuator; or a dual coil in-line actuator. The dual coil in-line actuator will include a first coil and a second coil, one of which is wound in a clockwise direction, and the other of which is wound in a counter-clockwise direction. The coils will be wound around the linkage 14 so that when one coil is energized, it will generate an electric field that operates to pull the linkage 14 in a first direction that moves the moving contact 19 away from the fixed contact 18. When the other coil is energized, it will generate an opposite electric field that operates to push the linkage in a second direction that moves the moving contact 19 toward the fixed contact 18. Other linear actuators may be employed, for example such as that shown and described in FIG. 14 and the corresponding text of U.S. Pat. No. 6,930,271, the disclosure of which is fully incorporated into this document by reference. However, the invention is not limited to embodiments that include linear actuators, as only a Thomson coil actuator is required in certain embodiments.

If the breaker includes a linear actuator 21, it also may include a resilient member 20 positioned at a second end of the pole unit 12. The second end of the pole unit 12 is the end opposite the first end, and is the end that is relatively proximate to the fixed contact 18. (In other words, the second end of the pole unit 12 is closer to the fixed contact 18 than it is to the moving contact 19.) The resilient member 20 may be, for example, a spring. The resilient member 20 may be inside of or outside of the pole unit 12, and the resilient member 20 is connected to a mounting bracket 31, either directly or indirectly via one or more components.

FIGS. 1A and 2A illustrate the circuit breaker 10 in a closed position. In this position, the fixed contact 18 and moving contact 19 are in contact with each other, providing a conductive path between the terminals 15, 16. In embodiments that include a resilient member 20, the resilient member 20 is in a relaxed/non-extended position when the circuit breaker is closed, and a gap 26 exists between the pole unit 12 and the linear actuator 21.

Figure 2B:
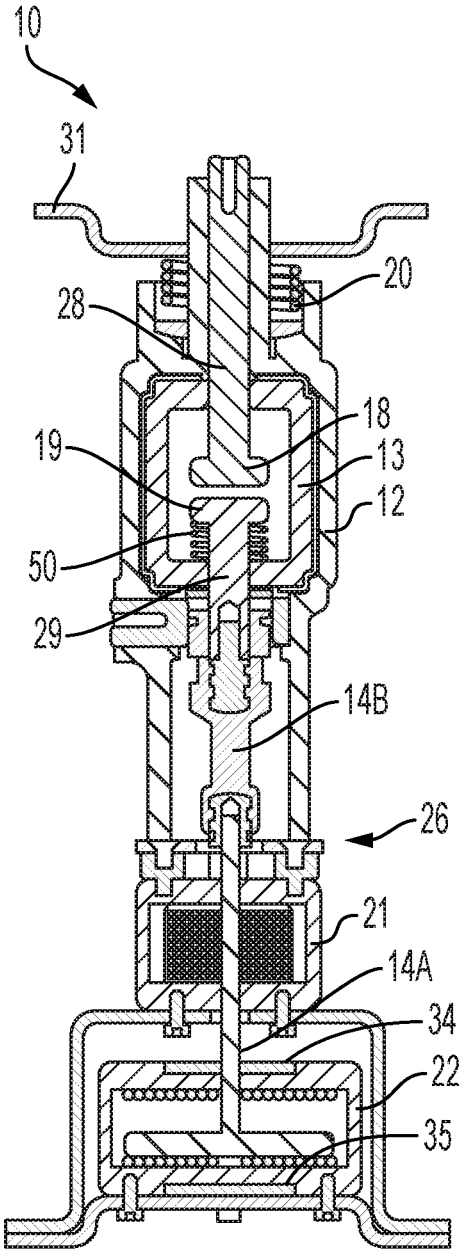
FIG. 2B illustrates the example circuit breaker in an open position.

FIGS. 1B and 2B illustrate the circuit breaker 10 in an open position. In this position, the fixed contact 18 and moving contact 19 are separated, thus interrupting the conductive path between the terminals 15, 16. In embodiments that include a resilient member 20, the resilient member 20 is in an extended position when the circuit breaker is open, and the gap 26 between the pole unit 12 and the linear actuator 21 is reduced or eliminated. A stop member 17 such as a plate or other structure may be positioned at the end of the gap 26 near the linear actuator 21 to limit the path of travel of the pole unit 12 toward the linear actuator 21.

In normal operation, such as conditions in which the current is at or below the rated current of the circuit breaker, the linear actuator 21 may operate to open and close the vacuum interrupter 13.

Figure 3:
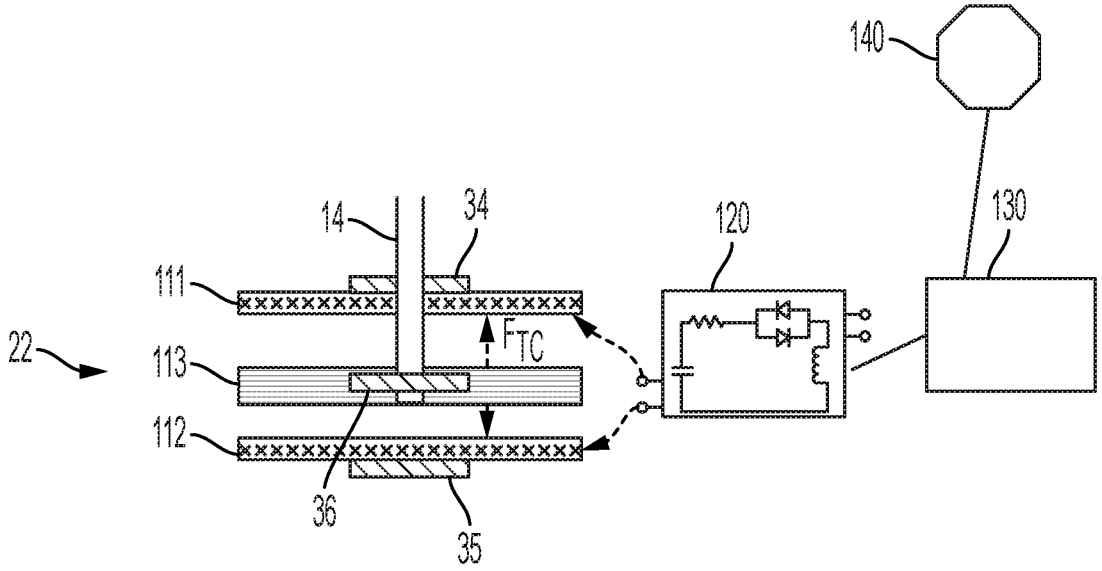
FIG. 3 illustrates components of a Thomson coil actuator that may be used in the circuit breaker discussed below.

FIG. 3 illustrates an example Thomson coil actuator 22 that includes a first Thomson coil 111, a second Thomson coil 112, and a conductive plate 113 positioned between the first and second Thomson coils to serve as an armature. At least the first Thomson coil 111, and optionally also the second Thomson coil 112, is a relatively flat spiral coil that is wound in either a clockwise or counterclockwise direction around the non-conductive linkage 14. The conductive plate 113 may be in the form of a disc or other structure that is connected to the linkage 14 to serve as an armature that may drive the linkage 14 in one direction or the other. The linkage 14 passes through the center of the Thomson coil 111 that receives the linkage from the vacuum interrupter via the linear actuator. Each Thomson coil 111, 112 is electrically connected to a driver 120.

The driver 120 may selectively energize either the first Thomson coil 111 or the second Thomson coil 112. When the driver 120 energizes the first Thomson coil 111, the first Thomson coil 111 will generate a magnetic force that will repel the conductive plate 113 away from the first Thomson coil 111 and toward the second Thomson coil 112. This causes the linkage 14 to move in a downward direction in the orientation shown, which moves the moveable electrode away from the fixed electrode in the vacuum interrupter and opens the circuit. In some embodiments, such as those in which a fast closing operation is desired, when the driver 120 energizes the second Thomson coil 112, the second Thomson coil 112 will generate a magnetic force that will repel the conductive plate 113 away from the second Thomson coil 112 and toward the first Thomson coil 111. This causes the linkage 14 to move in an upward direction in the orientation shown, which moves the moveable electrode (and thus the moveable contact) toward the fixed contact in the vacuum interrupter and closes the circuit.

The Thomson coil actuator also may include permanent magnets 34, 35 positioned proximate to each Thomson coil 111, 112, and a permanent magnet 36 on the conductive plate 113, that will latch the conductive plate 113 with the Thomson coil (111 or 112) to which it is adjacent. When a Thomson coil (111 or 112) to which the conductive plate 113 is latched is energized, the magnetic repulsion force will push the conductive plate 113 toward the other Thomson coil and operate to de-latch the plate from its current position.

The Thomson coil actuator's driver may be controlled by a controller 130, such as a microprocessor or other processing device that is programmed or encoded to selectively energize and de-energize the Thomson coils of the actuator. The controller 130 also may be programmed or encoded to vary the current applied to the Thomson coils as a function of circuit conditions detected by the sensor 40, as will be discussed below.

Figure 4:
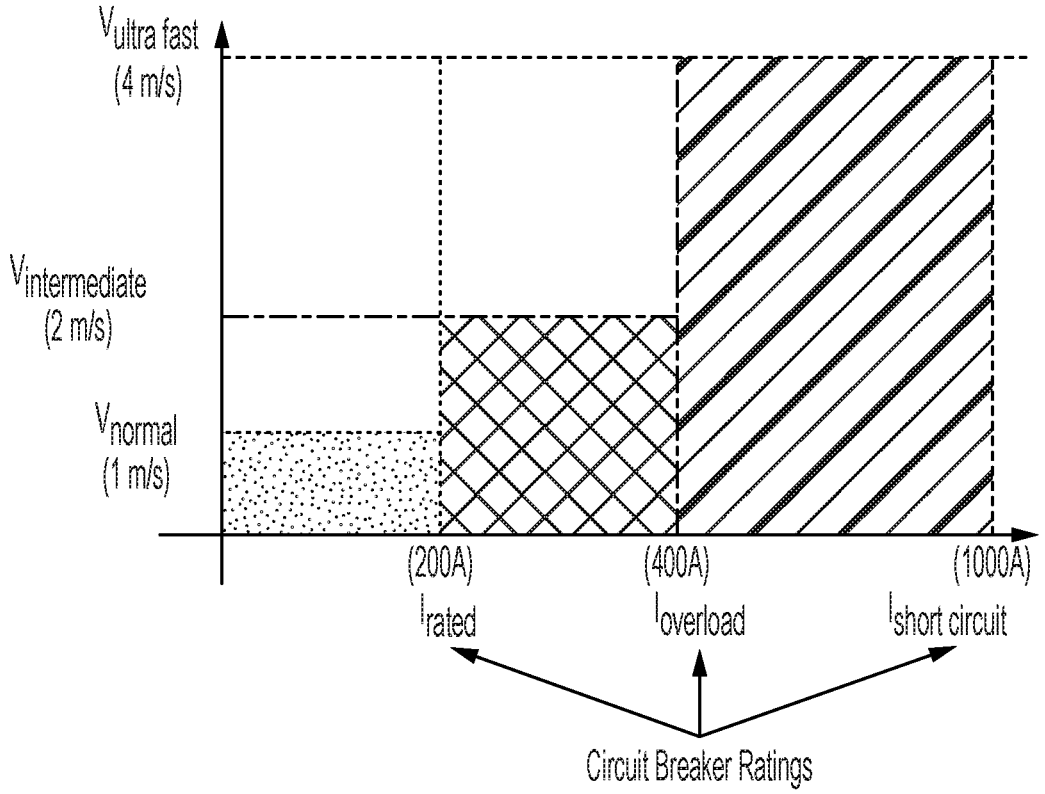
FIG. 4 illustrates example modes of operation in which current applied to the Thomson coil actuator is varied based on sensed current or voltage levels in the system.

The Thomson coil thus allows for fast operation when needed. However, as noted above, fast operation may result in a significant level of mechanical stress in the circuit breaker. High-speed operation can create a high level of mechanical impact on the circuit breaker's switching mechanism and pole unit. It can also reduce the life of a vacuum interrupter's bellows, which may be prone to cracking if repeated high impact cycling occurs, To address this issue, in various embodiments the system may vary the speed of operation of the Thomson coil actuator in response to, and as a function of, the value of current or voltage levels detected by one or more sensors at the time of operation. For example, referring to FIG. 4, a Thomson coil actuator may be capable of moving the moving electrode at an ultra-fast speed of 4 m/s, but that speed may not be required if conditions are not above an overload condition (which in this example is 400 amperes).

Thus, the controller may only direct a full (highest) current level to the Thomson coils if the sensed current exhibits a level that is at or above an overload condition. The full current level will be that which causes the Thomson coil actuator operate with its highest force and thus move the linkage at the fastest possible speed that the Thomson coil actuator can achieve (e.g., 4 m/s).

If the sensed current level is below an overload condition (e.g., 400 A) but still above the breaker's rated current level (e.g., 200 A), the controller may apply a reduced current level to the Thomson coil actuator. At the reduced current level, the actuator will apply less force to the conductive plate. The conductive plate and its attached linkage will thus move at a relatively lower speed, such as 2 m/s. Thus will cause less impact-related stress on various components than faster operation.

If the sensed current level is at or below the breaker's rated current level (e.g., 200 A) and thus also by definition below an overload condition (e.g., 400 A), the controller may apply a further reduced current level to the Thomson coil actuator. At the further reduced current level, the actuator will apply even less force to the conductive plate, resulting in an even lower speed, such as 1 m/s. Thus will cause even less impact-related stress on various components than faster operation conditions described above.

The current levels that are applied to any particular Thomson coil actuator may vary as a function of the Thomson coil actuator's design. Also, instead of implementing a stepwise adjustment to the current level based certain thresholds as described above, the system may vary the current level as a function of the sensed current, such as a linear function in which the applied actuation current decreases as the sensed current level decreases. Other functions may be used to achieve desired speeds of operation.

Optionally, in embodiments that include both a linear actuator and a Thomson coil actuator, if the sensed current level is at or below a certain threshold (such as the breaker's rated current level), then the current applied to the Thomson coil may be at or near zero, and the controller may instead actuate the linear actuator to open and separate the contacts. In this situation, the Thomson coil will not actuate at all, and thus the Thomson coil will not cause impact-related stress in situations where the Thomson coil's fast action is not needed.

Figure 5:
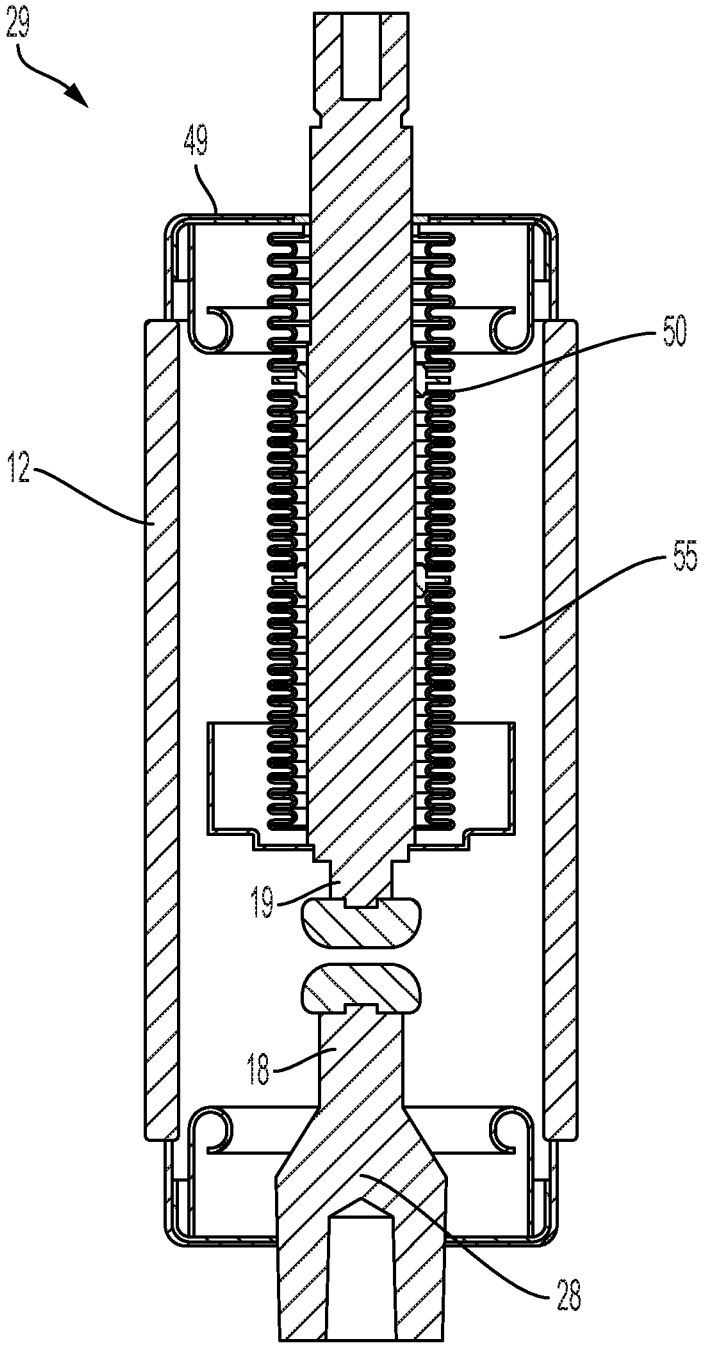
FIG. 5 is a close-up view of an embodiment of a vacuum interrupter component of a circuit breaker.
Figure 6:
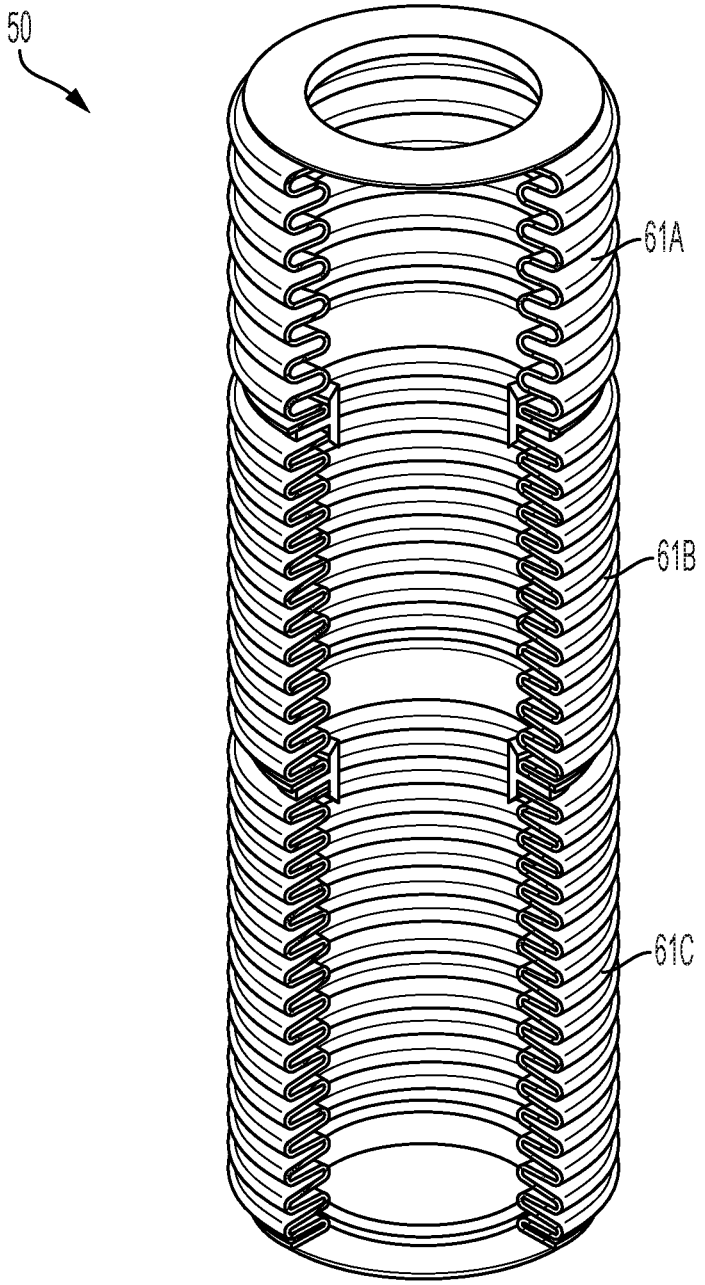
FIG. 6 illustrates an example bellows structure that may be employed within a vacuum interrupter component such as that of FIG. 5.

Varying the speed of operation of the unit can help improve the life and/or operations of various components of an interrupter. One such component is the bellows of the vacuum interrupter. As shown in FIGS. 2A and 2B, and also in the close-up of FIG. 5, a bellows 50 is typically positioned around the moveable electrode 29. The bellows 50 serves to maintain the seal in the vacuum chamber 55 while the moveable electrode 29 moves toward and away from the fixed electrode 28. The moveable electrode 29 will directly or indirectly connect to the linkage discussed above. As illustrated in FIG. 6, the bellows 50 may have any number of sections, each of which is of a construction that differs from that of the other sections. The different constructions that may be employed include different materials having different relative levels of flexibility/rigidity, different thicknesses, differently sized folds, or other construction parameter variations between sections. The different sections may thus be tuned to correspond to different operation speeds of the Thomson coil actuator, so that one section of the bellows will dominate (i.e., move by contracting or expanding a greater distance than, or move more quickly than) the other sections, depending on the speed of operation that the Thomson coil actuator applies to the moveable contact 19, thus making the most use of the dominant section while also preserving the life of the other non-dominant sections. The example shown in FIG. 6 includes three such sections 61A, 61B, 61C, but in practice any number of two or more sections may be used in embodiments that include this feature.

The illustrations shown in this document show the fixed electrode located at an upper portion of the breaker, the moving electrode at a lower portion of the breaker, and the actuators positioned below the moving electrode. However, the invention includes embodiments in which the arrangements are inverted, rotated to an angle (such as by 90 degrees to form a linear/horizontal arrangement), or otherwise. Embodiments also include arrangements in which a single set of actuators are connected to multiple pole units, as in a three-phase AC system. In such arrangements, the actuators may be connected to an operative arm, and the operative arm may be connected to the linkages of all three pole units.

In addition, the example embodiments discussed above show the use of a Thomson coil. However, alternate embodiments of the invention may include other high-speed actuators, such as moving coil actuators, piezoelectric actuators, or other actuators that are operable to separate the moving and fixed contacts at a speed that is higher than the fastest speed that the system's linear actuator can achieve. For example, traditional linear actuators in medium voltage applications have an operating speed that can move and separate the electrodes at a speed of about 4 m/s. In medium voltage applications of the present disclosure, the high-speed actuator may have an operating speed that can move the contacts at a faster speed such that a gap of from 1.5 mm to 2.0 mm may be opened between the electrodes in less than 0.5 milliseconds. Other gap sizes and speeds may be possible in various embodiments. Such high opening speeds are important when the breaker encounters high impulse voltage spikes and extreme overcurrents. Thus, the linear actuator may have a speed sufficient for a rated voltage of the breaker (e.g., 6 KV), but a faster opening speed may be required if, for example, a transient recovery voltage such as 12 kV or higher appears across the vacuum interrupter.

Figure 7:
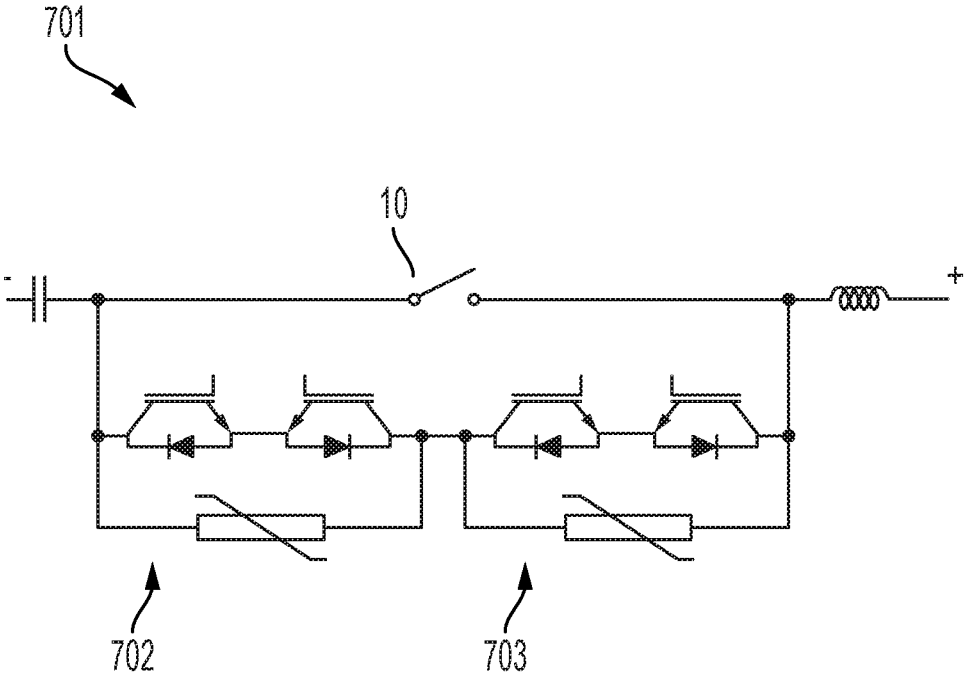
FIG. 7 is a diagram that illustrates various components that a medium voltage DC hybrid circuit breaker may include.

FIG. 7 illustrates example components of a medium voltage DC hybrid circuit breaker 701 with which a vacuum interrupter switch 10 such as that described above may be employed. FIG. 7 illustrates that the medium voltage DC hybrid circuit breaker 701 will include one or more solid state switches 702, 703. The solid state switches 702, 703 will be electrically connected in series with each other, and in parallel with the vacuum interrupter switch 10, between a line and a load.

Additionally, the embodiments described above may be used in medium voltage applications, although other applications such as low voltage or high voltage applications may be employed. The modes of operation described above also may be employed in a hybrid circuit breaker that includes both solid state and vacuum interrupter components.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A method of operating a circuit breaker, the method comprising:

by a controller of a circuit breaker having a single Thomson coil actuator that is operable to separate and open contacts of the circuit breaker:

receiving, from a sensor, a sensed level of current or voltage in the circuit breaker;

determining, based on the sensed level, that one of a plurality of fault conditions exists:

selecting, from a plurality of current levels corresponding to the plurality of fault conditions, an actuating current level corresponding to the existing fault condition; and applying the selected actuating current level to the Thomson coil actuator to cause the contacts to separate and open, wherein each current level in the plurality of current levels corresponds to a distinct opening speed such that applying the actuating current level to the actuator separates and opens the contacts at a speed different than the speed at which the actuator would separate and open the contacts if a different current level were to be selected.

2. The method of claim 1, wherein selecting the current level to apply to the Thomson coil actuator comprises:

determining that the sensed level corresponds to an overload condition; and in response, selecting a full current level that corresponds to a fastest speed of operation of the Thomson coil actuator.

3. The method of claim 1, wherein selecting the current level to apply to the Thomson coil actuator comprises:

determining that the sensed level is above a rated level of the circuit breaker but below an overload condition; and in response, selecting a current level that corresponds to a less than full level and that will cause the Thomson coil actuator to operate at a speed that is less than its fastest speed of operation.

4. The method of claim 1, wherein selecting the current level to apply to the Thomson coil actuator comprises:

determining that the sensed level is both at or below a rated level of the circuit breaker and below an overload condition; and in response, selecting a current level that corresponds to a less than full level and that is less than a current level that the controller would select if the sensed level were above the rated level but below the overload condition.

5. The method of claim 1, wherein selecting the current level to apply to the Thomson coil actuator comprises:

determining that the sensed level is both at or below a rated level of the circuit breaker and below an overload condition; and in response:

selecting a current level that will not cause the Thomson coil actuator to actuate, and applying current to a linear actuator and thus causing the contacts to separate and open by action of the linear actuator instead of the Thomson coil actuator.

6. The method of claim 1, wherein:

the circuit breaker comprises a vacuum interrupter;

the fixed contact is connected to a moveable electrode;

the movable electrode extends into a bellows;

the bellows comprises a plurality of sections, each of which exhibits one or more structural differences as compared to the other sections; and applying the selected current level to the Thomson coil actuator and causing the contacts to separate and open will cause one of the sections of the bellows to move more than the other sections.

7. The method of claim 1, wherein:

the circuit breaker comprises a vacuum interrupter that includes a bellows;

the bellows comprises a plurality of sections, each of which exhibits one or more structural differences as compared to the other sections; and applying the selected current level to the Thomson coil actuator will cause a first section of the bellows to move more quickly than, or to a greater distance than, a second section of the bellows.

8. The method of claim 7, wherein the first section of the bellows and the second section of the bellows are constructed of different materials.

9. The method of claim 7, wherein the first section of the bellows and the second section of the bellows are constructed with different thicknesses or with differently sized folds.

10. A vacuum interrupter system, comprising:

a fixed contact;

a moveable contact;

a single Thomson coil actuator structured to separate and open the contacts;

a bellows that comprises a plurality of sections; and a controller that is operable to:

receive, from a sensor, a sensed level of current or voltage in the circuit breaker;

determine, based on the sensed level, that one of a plurality of fault conditions exists;

select, from a plurality of current levels corresponding to the plurality of fault conditions, an actuating current level corresponding to the existing fault condition; and apply the selected actuating current level to the actuator to separate and open the contacts;

wherein the bellows are structured such that separating and opening the contacts causes a first section of the bellows to move more quickly than, or to a greater distance than, a second section of the bellows, and wherein each current level in the plurality of current levels corresponds to a distinct opening speed such that applying the actuating current level to the actuator separates and opens the contacts at a speed different than the speed at which the actuator would separate and open the contacts if a different current level were to be selected.

11. The vacuum interrupter system of claim 10, wherein:

the Thomson coil actuator comprises a first Thomson coil, a second Thomson coil, and a conductive plate positioned between the first and second Thomson coil; and the vacuum interrupter system further comprises a linkage that extends from the moveable contact, passes through the first Thomson coil and is positioned to be driven by the conductive plate.

12. The vacuum interrupter system of claim 10, wherein the controller is further configured to, when selecting the current level to apply to the actuator:

determine whether the sensed level corresponds to an overload condition; and when the sensed level corresponds to an overload condition, select a full current level that corresponds to a fastest speed of operation of the actuator.

13. The vacuum interrupter system of claim 10, wherein the controller is further configured to, when selecting the current level to apply to the actuator:

determining whether the sensed level is above a rated level of the vacuum interrupter but below an overload condition; and when the sensed level corresponds to an overload condition, select a current level that corresponds to a less than full level and that will cause the actuator to operate at a speed that is less than its fastest speed of operation.

14. The vacuum interrupter system of claim 10, wherein the controller is further configured to, when selecting the current level to apply to the actuator:

determine whether the sensed level is both at or below a rated level of the vacuum interrupter and below an overload condition; and in response, selecting a current level that corresponds to a less than full level and that is less than a current level that the controller would select if the sensed level were above the rated level but below the overload condition.

15. The vacuum interrupter system of claim 10, wherein:

the vacuum interrupter system further comprises a linear actuator; and the controller is further configured to, when selecting the current level to apply to the actuator:

determine whether the sensed level is both at or below a rated level of the circuit breaker and below an overload condition; and in response:

select a current level that will not cause the Thomson coil actuator to actuate, and apply current to the linear actuator and thus cause the contacts to separate and open by action of the linear actuator instead of the Thomson coil actuator.

16. A vacuum interrupter system, comprising:

a fixed contact;

a moveable contact;

single actuator structured to separate and open the contacts;

a bellows that comprises a plurality of sections; and a controller that is operable to:

receive, from a sensor, a sensed level of current or voltage in the circuit breaker;

determine, based on the sensed level, that one of a plurality of fault conditions exists;

select, from a plurality of current levels corresponding to the plurality of fault conditions, an actuating current level corresponding to the existing fault condition; and apply the selected actuating current level to the actuator to separate and open the contacts;

wherein the bellows are structured such that separating and opening the contacts causes a first section of the bellows to move more quickly than, or to a greater distance than, a second section of the bellow, and wherein each current level in the plurality of current levels corresponds to a distinct opening speed such that applying the actuating current level to the actuator separates and opens the contacts at a speed different than the speed at which the actuator would separate and open the contacts if a different current level were to be selected.

17. The vacuum interrupter system of claim 16, wherein the controller is further configured to, when selecting the current level to apply to the actuator:

determine whether the sensed level corresponds to an overload condition; and when the sensed level corresponds to an overload condition, select a full current level that corresponds to a fastest speed of operation of the actuator.

18. The vacuum interrupter system of claim 16, wherein the controller is further configured to, when selecting the current level to apply to the actuator:

determining whether the sensed level is above a rated level of the vacuum interrupter but below an overload condition; and when the sensed level corresponds to an overload condition, select a current level that corresponds to a less than full level and that will cause the actuator to operate at a speed that is less than its fastest speed of operation.

19. The vacuum interrupter system of claim 16, wherein the controller is further configured to, when selecting the current level to apply to the actuator:

determine whether the sensed level is both at or below a rated level of the vacuum interrupter and below an overload condition; and in response, selecting a current level that corresponds to a less than full level and that is less than a current level that the controller would select if the sensed level were above the rated level but below the overload condition.

* * * * *